United States Patent [19]

Cindric et al.

[11] Patent Number: 4,706,915

[45] Date of Patent: Nov. 17, 1987

[54] MULTI-SUPPORT DISPLAY STAND FOR HUMAN-SHAPED FIGURES

[76] Inventors: Joseph M. Cindric; Mary T. Cindric, both of 6393 Stuart Rd., Adkins, Tex. 78101

[21] Appl. No.: 846,259

[22] Filed: Mar. 31, 1986

[51] Int. Cl.[4] ..... F16M 11/12; A47F 5/06

[52] U.S. Cl. ..... 248/122; 248/161; 248/175

[58] Field of Search ..... 248/161, 125, 122, 106, 248/105, 295, 175, 231, 176; 269/323, 328

[56] References Cited

U.S. PATENT DOCUMENTS

| | | | |
|---|---|---|---|
| 479,481 | 7/1892 | Wilcox . | |
| 1,505,649 | 8/1924 | Levy | 248/125 |
| 2,474,050 | 6/1949 | Harris | 248/118 X |
| 2,630,288 | 3/1953 | Eubanks, Sr. | 248/125 X |
| 3,009,284 | 11/1961 | Ryan | 46/32 |
| 3,071,410 | 1/1963 | Gaskins | 248/175 X |
| 3,120,836 | 2/1964 | Brauning | 269/328 X |
| 3,516,632 | 6/1970 | Hall | 248/176 |
| 3,567,084 | 3/1971 | DeWitt | 223/120 |
| 3,675,362 | 7/1972 | de Gelder | 46/13 |
| 4,127,251 | 11/1978 | Sapkus et al. | 248/176 |

FOREIGN PATENT DOCUMENTS

| | | | |
|---|---|---|---|
| 266973 | 3/1927 | United Kingdom | 269/328 |
| 451654 | 8/1936 | United Kingdom | 248/122 |

OTHER PUBLICATIONS

Dollspart, Supply Company, Inc., undated, cover, inside front cover, p. 10.

Unknown author, no title, advertizing showing Doll Stands, undated.

*Primary Examiner*—Ramon S. Britts

*Assistant Examiner*—Karen J. Chotkowski

*Attorney, Agent, or Firm*—Gunn, Lee & Jackson

[57] ABSTRACT

A display stand for supporting either a rigid or non-rigid doll or other inanimate human-shaped figure. A flat base and vertical post balance the figure in an upright position. The vertical post telescopes to adjust for the height of the figure. A bracket and a belt extend from the post and provide further support for the figure. The bracket fits under and against the figure's pelvis, providing upward support, and may be moved along the vertical post to adjust for the length of the figure's legs. The belt fits around the figure's torso. Both the bracket and the belt are sufficiently flexible so as to adjust for the figure's circumference and to not mar its surface or weaken its structure. A variation of the display stand permits the figure to be held in a range of positions varying from vertical to horizontal.

13 Claims, 7 Drawing Figures

MULTI-SUPPORT DISPLAY STAND FOR HUMAN-SHAPED FIGURES

BACKGROUND OF THE INVENTION

The invention relates to the field of display stands for dolls or other inanimate figures of human-shaped beings. More particularly, the invention relates to stands that do not require the figure to be already configured for use with a particular stand or to be modified for use with the stand.

Devices for displaying dolls are typically used to balance the figure in a vertical position. One type is a stand that requires a bar or rod to be projected into the body of the figure. Stands of this type are disclosed in U.S. Pat. Nos. 3,009,284 and 3,010,225. This type of stand in unsatisfactory because it requires either that the figure be already configured for use with the stand or that the figure be modified, such as by drilling a hole into it.

Another type of stand grips or restrains the feet or legs on the figure. Such stands are disclosed in U.S. Pat. Nos. 3,516,632 and 3,675,362. In the first of these patents, the stand grips both legs near the hips. In the second, the legs are restrained below the knees. U.S. Pat. Nos. 3,567,084 and 4,127,251 disclose stands for supporting a doll by clamping onto one foot or one leg. Such doll stands are limited in usefulness because they are only able to support a doll that is rigid through the legs, back and shoulders. Further, such stands are inherently unstable unless the base is substantially heavy to compensate for the lack of support for the upper portion of the figure.

Another type of doll stand includes a base with a vertical framework having portions that grip the figure under the arms or around the waist. A stand of this type is disclosed in U.S. Pat. No. 479,481, in which the figure is grasped around the waist with spring-tensioned arms. Another stand of this type is disclosed in U.S. Pat. No. 3,009,284. These grip-type stands are undesirable for fragile or delicate figures because the figure merely hangs from a single gripping position. This position could weaken a delicate figure. These grip-type stands are also undesirable because the gripping means are necessarily rigid. The gripping means rely on substantial pressure against the figure, and therefore tend to tear, mar, and weaken the surface of fragile and delicate figures. Furthermore, if the gripping means are placed over the clothing, the clothing is likely to be torn and dressing or undressing the figure is inhibited. Nor do the gripping means contour to the shape of the figure's body, and thus tend to result in an unsightly appearance whether placed inside or outside of the figure's clothing. The gripping also means tend to slip on round-bodied figures.

Still other doll stands have used a Y-shaped vertical support in which the figure straddles the fork of the Y. Such stands are undesirable because there is nothing to support the upper torso and nothing to prevent the figure from falling sideways.

None of the above stands are desirable for use with fragile or delicate figures, such as antique dolls. For such figures, it is desirable to have a stand that supports the figure in more than one place. Preferably, the means of supporting the figure should be those means that are least likely to weaken the figure's structure, and offset the effects of gravity by supporting the figure from underneath its center of gravity.

Additionally, none of the stands listed above easily allow the figure to be dressed and undressed without removing the figure from the stand, Dressing and undressing in each of the types of stands discussed above requires that the figure be unfastened or removed from all support means. This is especially detrimental for antique, fragile, or valuable figures, where limited handling is desirable.

Additionally, the above-described stands each require to some extent that the figure be balanced on, or supported by, its own feet. If the feet are not flat on the bottom, the stability of the doll in the stand is impaired.

Finally, none of these stands are adaptable to support a figure in a non-vertical position. Thus, they have limited usefulness when it is desired to display the figure in a tilted position. They also have limited usefulness for "baby dolls", whose legs are in a bowed position similar to those of a newborn human infant.

SUMMARY OF THE INVENTION

An object of the invention is to provide an adjustable stand for supporting either a rigid or non-rigid, inanimate, human-shaped figure in a secure, upright position. A telescoping post permits adjustment of the stand to accommodate figures of varying heights. A bracket extends from the mid-portion of the post and supports the figure under and against its lower torso. A lateral back support and belt extend from the upper end of the post and support the figure around its upper torso. A flat base is sufficiently heavy to stabilize the stand.

A further object of the invention is to provide a stand that is adjustable for differently proportioned figures. The bracket is adjustable in height to permit support for figures of varying leg length and is adjustable in depth to permit support for figures of varying hip circumference. Similarly, the belt is adjustable to permit support for figures of varying torso circumference.

A further object of the invention is to provide a stand that easily permits the figure to be dressed and undressed without removal from the stand. The bracket and the belt independently support the figure. Thus, one support means can be removed without the figure falling over.

A further object of the invention is to provide a stand that will not allow the figure to rotate around the stand. Thus, the telescoping post may be rectangular in cross-sectional area.

A further object of the invention is to provide a stand that is not destructive to fragile or delicate figures. Thus, the bracket may be covered with soft material and the belt may be made from soft, flexible materials.

A further object of the invention is to provide a stand that is adaptable so that it may be used for holding the figure in positions that range from vertical to horizontal. Thus, the inner bar of the telescoping post may be replaced with another bar having a pivot fastener at it upper end. The bracket is replaced with a modified bracket, whose mid-portion is attached to the top of the telescoping post by means of the pivot fastener. The lateral back support and belt extend from this modified bracket at its upper end, rather than from the upper end of the telescoping post. The pivot fastener permits adjustment of the figure to any position ranging from vertical to horizontal.

DESCRIPTION OF THE PREFERRED EMBODIMENT

Figure 1:
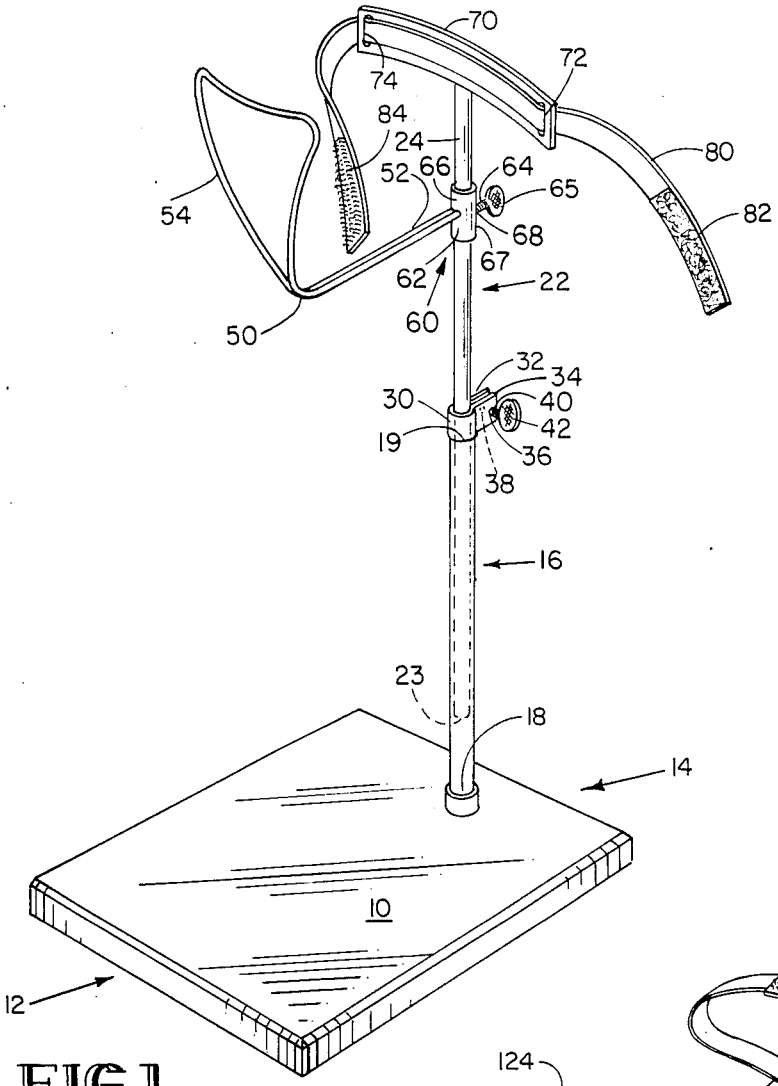
FIG. 1 is a perspective view of the stand as used for holding a figure in an upright position.

Referring to FIG. 1, the invention has a flat base 10, having a front end 12 and a back end 14. The base 10 is of a size and shape to deter the stand from toppling due to an imbalance of weight when the stand holds a figure.

The base 10 has a hollow outer vertical bar 16 mounted on it. The lower end 18 of the outer vertical bar 16 is attached to the base 10, and the upper end 19 of the outer vertical bar 16 extends upward perpendicular to the base 10. An inner vertical bar 22 is slideably placed inside the outer vertical bar 16. The inner vertical bar 22 has a cross sectional area of the same proportions, but of slightly smaller dimensions than the outer vertical bar 16. The lower end 23 of the inner vertical bar is slidably engaged by the outer vertical bar 16, and the upper end 24 of the inner vertical bar 22 extends upward perpendicular to base 10. The configuration of the outer and inner vertical bars 16 and 22 allows the inner vertical bar 22 to telescope inside the outer vertical bar 16.

To secure the inner vertical bar 22 at a desired position inside the outer vertical bar 16, a first locking means 30 is located at the upper end 19 of the outer vertical bar 16. The first locking means 30 comprises two flanges 32 and 34 extending from opposing sides of the outer vertical bar 16. These flanges each have an orifice 36 and 38 through which a tightening screw 40 passes. The tightening screw 40 is outwardly threaded. One or both of the orifices 36 and 38 may be inwardly threaded. When the tightening screw 40 is tightened, the flanges are pushed against opposing sides of the inner vertical bar 22, thereby securing the inner vertical bar 22 at a desired position. The tightening screw 40 has a lug head 42 so that the first locking means 30 may be tightened and loosened without the aid of tools.

A bracket 50 extends from the inner vertical bar 22. Preferably, the bracket 50 is made of semi-rigid material and is covered with a soft coating. The bracket 50 is sufficiently flexible to permit it to be bent to conform to the shape of the figure's torso, and is sufficiently rigid to permit it to securely hold the figure in a desired orientation. The bracket 50 has a rear portion 52 and a front portion 54. The rear portion 52 of the bracket 50 is sufficiently narrow to permit it to fit under the pelvis between the legs of the figure to be supported. The end of the rear portion 52 of the bracket 50 is joined to the inner vertical bar with a second locking device 62. The front portion 54 of the bracket 50 extends toward the front end 12 of the base 10, and forms a brace for supporting the lower torso of the figure.

The second locking means 60, which is attached to the bracket 50, includes a rigid collar 62 and a tightening screw 64. The collar 62 surrounds the inner vertical bar 22 and has an inner cross-sectional area that is of the same proportions but of slightly larger dimensions than the inner vertical bar 22. The collar 62 has a rear side 67 and a front side 66. The front side 66 of the collar 62 is attached to the end of the rear portion 52 of the bracket 50. The rear side 67 of the collar 62 has an inwardly threaded aperture 68 through which the tightening screw 64 passes. The tightening screw 64 is outwardly threaded. The tightening screw 64 may be screwed into or out of the aperture 68, thereby securing or unsecuring the bracket 50 at a desired location along the inner vertical bar 22. The tightening screw 64 has a lug head 65 so that the second locking means 60 may be tightened and loosened without the aid of tools.

At the upper end 24 of the inner vertical bar is a lateral support bar 70 for supporting the upper torso of the figure against the inner vertical bar 22. Preferably, the lateral back support bar 70 is slightly arcuate, with the concave side facing the front 12 of the base 10. The lateral back support bar may also have slots 72 and 74 through which a belt 80 passes. The lateral support bar 70 is sufficiently flexible to allow for adjustment to accommodate the curvature of the figure's torso, and sufficiently rigid to permit it to securely hold the figure in a desired position.

The belt 80 provides further support for the figure around its upper torso. Preferably, the belt is made of soft, flexible material. The ends 82 and 84 of the belt fasten together with hook and eye fastening means.

Figure 2:
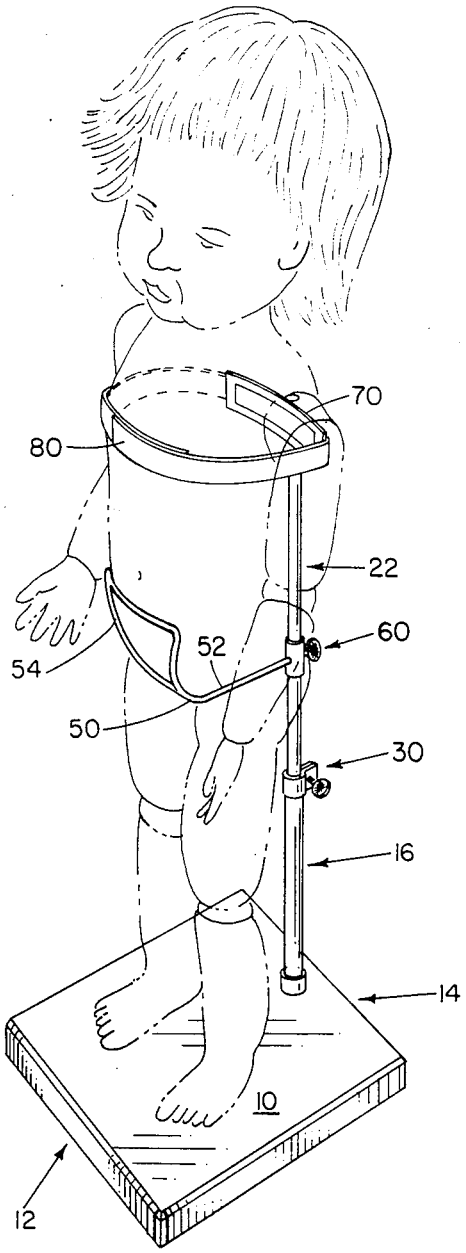
FIG. 2 is a perspective view of the stand shown in FIG. 1, holding a figure, as supported by the stand in FIG. 1.

FIG. 2 shows the display stand in FIG. 1 with a figure mounted thereon. The figure's feet rest on the top of the base 10. The front of the figure faces the front 12 of the base 10. The legs of the figure straddle the rear portion 52 of the bracket 50. The figure may thereby be supported upwardly, so that, if desired, all or most of its weight rests on the bracket rather than on the base 10. The lower torso of the figure is supported against the vertical bar 22 by the front portion 54 of the bracket 50. The upper torso of the figure rests against the lateral support bar 70 and is held against the lateral support bar 70 by the belt 80. The curvature of the lateral support bar may be adjusted to accommodate the curvature of the circumference of the figure's upper torso. The height of the inner vertical bar 22 is adjusted to a position inside the outer vertical bar 16 to accommodate the overall height of the figure. The height of the bracket 50 is adjusted along the inner vertical bar 22 to accommodate the length of the figure's legs. The front portion 54 of the bracket 50, being of semi-rigid material, may be bent to accommodate the thickness of the lower torso and to thereby cradle the lower torso of the figure into the bracket 50 and against the inner vertical bar 22. The belt 80 is adjusted to accommodate the circumference of the upper torso of the figure and to secure it against the lateral support 70. The bracket 50 may be removed from the inner vertical bar 22 if desired, and may be slid down the vertical bar 22 for ease in dressing and undressing or otherwise handling the figure.

Figure 3:
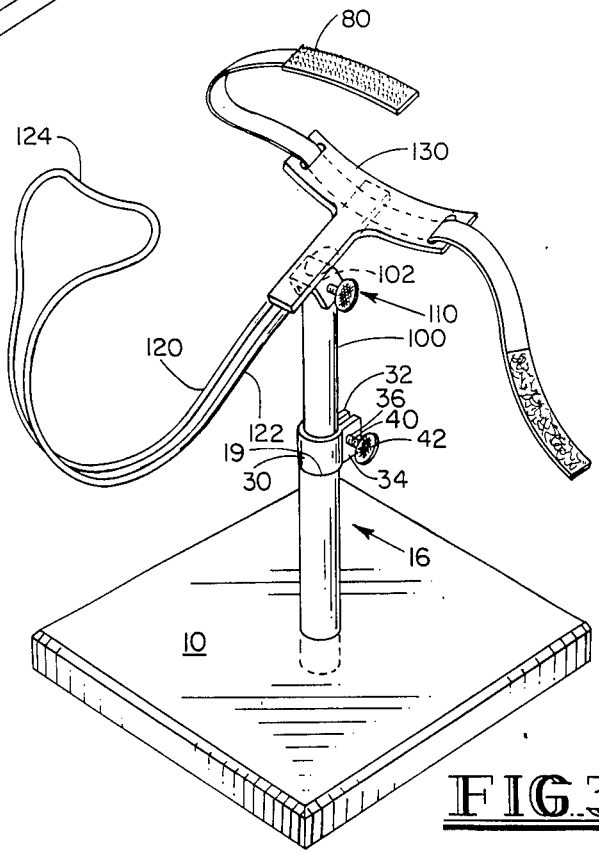
FIG. 3 is a perspective view of the stand with an alternative bracket, inner vertical bar, and pivot fastener.

FIG. 3 shows an alternative configuration of the stand shown in FIG. 1, wherein the inner vertical bar 22, second locking means 60 and bracket 50 shown in FIG. 1 have been replaced with a substitute inner vertical bar 100, pivot fastener 110 and bracket 120. In FIG. 3, the pivot fastener 110 is attached to the top of the inner vertical bar 100. The inner vertical bar 100 has a bore 102 drilled through its upper end.

Figure 4:
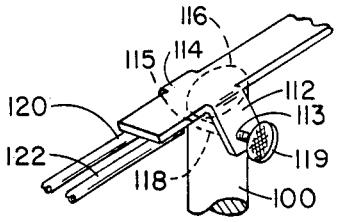
FIG. 4 is a detail view of the pivot fastener shown in FIG. 3.

FIG. 4 is a detail view of the pivot fastener 110 shown in FIG. 3. The pivot fastener 110 has two arms 112 and 114 and a connecting bar 116. The arms are sufficiently spaced apart to allow the top of the inner vertical bar 100 to fit between them. Each of the arms 112 and 114 have an aperture 113 and 115 that is congruous to the bore 102 in the upper end of the inner vertical bar 100. Through this bore 102 and these apertures 113 and 115 passes a tightening screw 119. One or both of the apertures 113 and 115 may be inwardly threaded. The top of the inner vertical bar 100 is a plane diagonal to the plane of the base 10. Depending on the slant of the diagonal, the top of the inner vertical bar prevents the bracket 110 from pivoting past a predetermined point. This prevents the doll, when placed in the stand from falling backward.

Referring again to FIG. 3, the substitute bracket 120 has a rear portion 122 and a front portion 124. The rear portion 122 is connected to a lateral support bar 130. Preferably, the lateral support means 130 has a slot on either end, through which the belt 80 passes. The lateral support bar 130 is of semi-rigid material, and is sufficiently flexible to permit adjustment to correspond to the curvature of the figure and sufficiently rigid to support the figure in a desired orientation.

Figure 5:
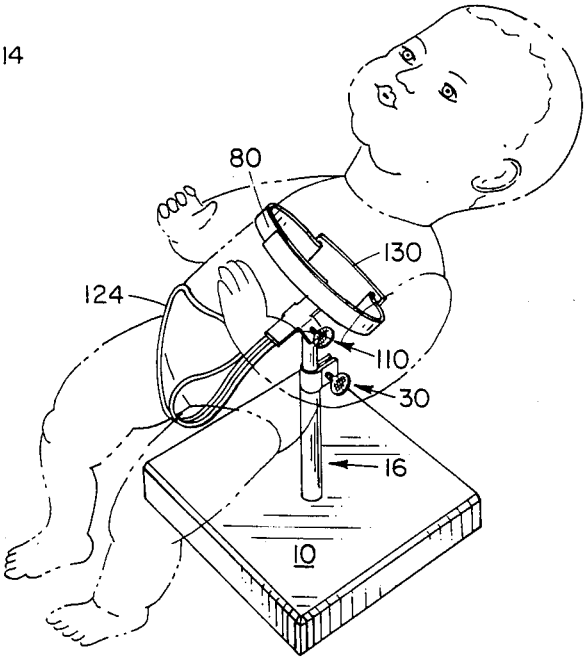
FIG. 5 is a perspective view of the stand shown in FIG. 3, holding a figure as supported by the stand in FIG. 3.

FIG. 5 shows the display stand in FIG. 3 with a figure mounted therein. The figure may rest in any position ranging from vertical to horizontal. The figure's legs straddle the bracket 120 and its lower torso is supported by the front portion 124 of the bracket 120. Its back is supported longitudinally by the rear portion 122, of the bracket 120 and laterally by the lateral support bar 130. The upper torso of the figure is secured against the lateral support bar 130 by the belt 80. The bracket 120, being of semi-rigid material, is sufficiently flexible to permit it to be shaped to conform to the thickness of the figure's torso and is sufficiently rigid to hold the figure in a desired orientation. The lateral support bar 130, being of semi-rigid material, is sufficiently flexible to permit it to be shaped to conform to the curvature of the figure's torso and is sufficiently flexible to hold the figure in a desired orientation. The belt 80 is adjusted to conform to the circumference of the upper torso.

It is to be understood that the lower portion of the doll stand, consisting of the base 10 and the outer vertical bar 16, shown in FIGS. 1 and 3, are the same. Thus, the alternative configurations of the upper portion of the stand, as shown by FIGS. 1 and 3, can be used interchangeably with a single base 10 and outer vertical bar 16.

Figure 6:
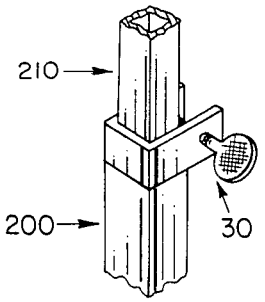
FIG. 6 is a perspective view of an alternative telescoping post.

FIG. 6 shows an alternative configuration of the outer 16 and inner 22 vertical bars of FIG. 1 or the outer 16 and inner 100 vertical bars of FIG. 3. The outer vertical bar 16 is replaced with an alternative outer vertical bar 200, whose inner cross-sectional area is rectangular. The inner vertical bar 22 is replaced with an alternative inner vertical bar 210, whose outer cross-sectional area is also rectangular in the same proportions but of slightly smaller dimensions than those of the outer vertical bar 200. The slidable engagement of the inner vertical bar 210 and outer vertical bar 200 prevents the inner vertical bar 210 from rotating relative to the outer vertical bar 200.

Figure 7:
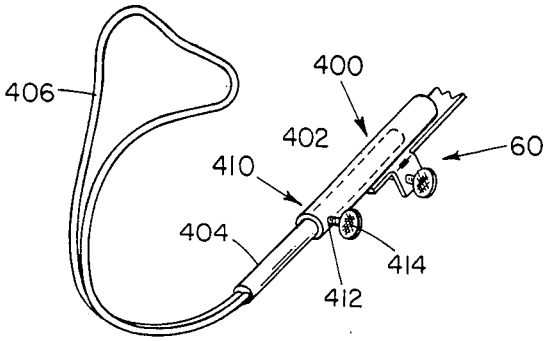
FIG. 7 is a perspective view of an alternative telescoping bracket for the bracket shown in FIG. 3.

FIG. 7 shows an alternative configuration of the bracket 120 in FIG. 3, with a telescoping adjustment means. Bracket 120 in FIG. 3 is replaced with bracket 400. This bracket 400 has a rear portion 402, a middle portion 404 and a front portion 406. The rear portion 402 is a hollow bar. The middle portion 404 is a bar whose outer cross-sectional area is of the same proportions but of slightly smaller dimensions than the inner cross-sectional area of the rear portion 402. One end of the middle portion 404 is slidably engaged by the rear portion, permitting the middle portion 404 to telescope inside the rear portion 402. A locking means 410 is located at an end of rear portion 402. This locking means 410 consists of an inwardly threaded aperture 412, through which a threaded tightening screw 414 passes. This telescoping adjustment of bracket 400 permits it to be adjusted to accommodate figures of varying torso lengths.

While the stand has been described in connection with its preferred embodiments, the description is not intended to limit the invention to the particular forms set forth. To the contrary, the description is intended to cover such alternatives, modifications, and equivalents as may be included within the spirit and scope of the invention as defined by the appended claims.

What is claimed is:

1. An adjustable apparatus for holding an inanimate human-shaped figure having legs and an upper torso, said apparatus comprising:

a base for anchoring said apparatus, said base being sized and shaped to deter said apparatus from toppling due to an imbalance of weight when said apparatus holds said figure, said base having a front end and a rear end;

an outer vertical bar extending upward from said base, said outer vertical bar having an upper end and lower end, said lower end being attached to said base;

an inner vertical bar having an upper end and a lower end, said lower end of said inner vertical base being slidably engaged by said upper end of said outer bar;

a first locking means located at said upper end of said outer bar for securing said inner vertical bar and said outer vertical bar relative to each other at any of at least two positions;

a bracket, adjustably supported at one or more positions on said inner vertical bar, said bracket having a rear end and a front end, said rear end being attached to said inner vertical bar and being sufficiently narrow to fit between the legs of said figure, said front end of said bracket being of sufficient width to rest across the abdomen of said figure;

a second locking means attached to said bracket for securing said bracket to any of at least two positions on said inner vertical bar thereby permitting adjustment for the leg length of said figure;

a lateral support means for supporting said upper torso of said figure against said inner vertical bar, said lateral support means being attached to said upper end of said inner vertical bar, and said lateral support operating independently of said bracket and being adjustable in distance from said base and said bracket by means of said first locking means thereby permitting adjustment for the torso length of said figure;

a belt attached to said lateral support means, said belt being comprised of soft flexible material, having first and second ends, and a fastening means for securing said first and second ends together.

2. The apparatus as recited in claim 1, wherein said first locking means comprises a first flange and a second flange and a tightening bolt, said first and second flanges extending from different sides of said upper end of said first bar, said flanges each having an orifice through which said tightening bolt passes.

3. The apparatus as recited in claim 1, wherein said bracket has a coating sufficiently soft to prevent marring of the surface of said figure.

4. The apparatus as recited in claim 1, wherein said bracket is sufficiently flexible to permit it to be bent into any of at least two different orientations and thereby allow adjustment for various sizes of said figures, and is sufficiently rigid to support said figure in said orientation.

5. The apparatus as recited in claim 1, wherein said lateral support means comprises a cross bar attached to said upper end of said inner vertical bar, said cross bar being generally parallel to the plane of said base, said cross bar being concave toward said front of said base, and said cross bar being sufficiently flexible to permit it to be bent to accommodate the shape of said figure and sufficiently rigid to support said figure.

6. The apparatus as recited in claim 1 or 5, wherein said second locking means comprises a rigid collar and an outwardly threaded tightening screw, said collar having an inner cross-sectional area in the same proportions but slightly larger dimensions than said inner vertical bar, said collar surrounding said inner vertical, said collar having a rear side and a front side, said front side of said collar being attached to said rear end of said bracket, said rear side of said collar having an inwardly threaded aperture capable of threadably engaging said tightening screw.

7. An apparatus for holding an inanimate human-shaped figure, said apparatus comprising:

a base for anchoring said apparatus, said base being sized and shaped to deter said apparatus from toppling due to an imbalance of weight when said apparatus holds said figure, said base having a front end and a read end;

an outer vertical bar extending upward from said base, said outer vertical bar having an upper end and lower end, said lower end being attached to said base, said outer vertical bar being hollow and the inner cross-section of said bar being rectangular;

an inner vertical bar, having an upper end and lower end, said inner vertical bar having an outer cross-section of the same proportions but of slightly smaller dimensions than of outer vertical bar, said inner vertical bar being slidably received into said outer vertical bar, thereby permitting a telescoping adjustment of said outer and inner vertical bars while at the same time preventing said inner vertical bar from rotating relative to said outer vertical bar;

a first locking means for securing said inner vertical bar at a desired position inside said outer vertical bar, said locking means comprising a first flange and a second flange and a tightening bolt, said first and second flanges extending from different sides at said upper end of said outer vertical bar, said flanges each having an orifice through which said tightening bolt pass;

a bracket, adjustably supported at one or more positions on said inner vertical bar, said bracket having a front end and rear end, said rear end being attached to said inner vertical bar and said rear end being sufficiently narrow to support said figure from beneath the pelvis by passing between the legs of said figure, said front end forming a brace for supporting said figure, said brace being of sufficient width to rest across the abdomen and covered with a soft material, and said brace being sufficiently flexible to permit it to be bent into any of at least two different orientations and thereby allow adjustment for various sizes of said figures and being sufficiently rigid to support said figure in said orientation;

a second locking means for securing said bracket to any of at least two positions on said inner vertical bar thereby permitting adjustment for the leg length of said figure, said locking means comprising a rigid collar and an outwardly threaded tightening screw, said collar being rectangular in its inner cross-sectional area in the same proportions but slightly larger dimensions than said inner vertical bar, said collar having a rear and a front side, said front side of said collar being attached to said rear end of said bracket, and said rear side of said collar having an inwardly threaded aperture through which said tightening screw passes;

a cross bar attached to said upper end of said inner vertical bar, said cross bar being generally parallel to the plane of said base, said cross bar being slightly concave toward said front of said base, and said cross bar being sufficiently flexible to permit it to be bent to accommodate the shape of said figure and sufficiently rigid to support said figure, and said cross bar providing support independently of said bracket and being adjustable in distance from said base and said bracket by means of said first locking means, thereby permitting adjustment for the torso length of said figure;

a belt attached to said cross bar, said belt being of soft flexible material and having first and second ends, and a fastening means for securing said first and second ends together.

8. An apparatus for holding an inanimate human-shaped figure having legs and an upper torso, said apparatus comprising:

a base for anchoring said apparatus, said base being sized and shaped to deter said apparatus from toppling due to an imbalance of weight when said apparatus holds said figures, said base having a front end and a rear end; .

an outer vertical bar extending upward from said base, said outer vertical bar having an upper end and lower end, said lower end being attached to said base;

an inner vertical bar having an upper end and a lower end, said lower end of said inner vertical bar being slidably engaged by said upper end of said first bar, said inner vertical bar having a bore extending through its upper end from one opposing side of said inner vertical bar to the other;

a first locking means located at said upper end of said outer vertical bar for securing said lower end of said inner vertical bar and said outer vertical bar relative to each other at any of at least two positions;

a bracket, said bracket having a generally straight rear portion and a generally curved front portion, said rear portion being attached to said inner vertical bar, and said front portion forming a U-shaped curve to fit between the upper legs of said figure wherein said bracket has a rear portion, middle portion, and front portion, said rear portion being attached to said inner vertical bar, said rear portion being hollow, said middle portion having a cross-sectional area in the same proportions but of slightly smaller dimensions than the inner cross-sectional area of said rear portion, said middle portion being slidably received into said rear portion, said middle and rear portions thereby allowing telescoping adjustment of said bracket, and said front portion forming a brace for supporting said figure between said legs of said figure;

a lateral support means for supporting said torso of said figure against said inner vertical bar, said lateral support means being attached to said upper end of said rear portion of said bracket;

a belt attached to said lateral support means, said belt being comprised of soft flexible material, having first and second ends and a fastening means for securing said first and second ends together said belt not cooperating with said bracket except at its point of attachment to said lateral support means;

a pivot fastener for securing said bottom of said rear portion of said bracket to said upper portion of said inner vertical bar, and for allowing said bracket to be pivoted back and forth from a direction parallel to said outer and inner vertical bars to a position perpendicular to said bars.

9. The apparatus as recited in claim 8, wherein said first locking means comprises a first flange and a second flange and a tightening bolt, said first and second flanges extending from different sides of said upper end of said first bar, said flanges each having an orifice through which said tightening bolt passes.

10. The apparatus as recited in claim 8, wherein said bracket has a coating sufficiently soft to prevent marring of the surface of said figure.

11. The apparatus as recited in claim 8, wherein said bracket is sufficiently flexible to permit it to be bent into any of at least two different orientations and sufficiently rigid to support said figure in said orientation to allow adjustment for various sizes of said figures.

12. The apparatus as recited in claim 8, wherein in said lateral support means comprises a cross bar, said cross bar being concave toward said front of said base, and said cross bar being sufficiently flexible to permit it to be bent to accommodate the shape of said figure and sufficiently rigid to support said figure.

13. The apparatus as recited in claim 8, wherein said inner vertical bar is lightly taller at its rear side, and said pivot fastener comprises a first arm and a second arm, connecting bar and a tightening screw, said first arm and second arm having sufficient space between them to allow the top of said inner bar to fit between them, said first arm and second arm each having an aperture congruous to said bore through said upper portion of said inner vertical bar, said apertures and said bore allowing passage of said tightening bolt, said first arm and said second arm being of such length as to prevent said pivot fastener from passing over said taller side of said inner vertical bar.

* * * * *